United States Patent [19]

Kessler

[11] 4,069,636

[45] Jan. 24, 1978

[54] INSULATION SUPPORTING STRAP

[76] Inventor: James E. Kessler, 3007 W. 82nd Terrace, Leawood, Kans. 66206

[21] Appl. No.: 752,018

[22] Filed: Dec. 20, 1976

[51] Int. Cl.[2] ..... E04B 1/38; E04C 3/16

[52] U.S. Cl. ..... 52/712; 52/357; 52/359; 52/407

[58] Field of Search ..... 52/712, 357, 361, 440, 52/359, 588, 336, 410, 407, 334, 450, 630

[56] References Cited

U.S. PATENT DOCUMENTS

| | | | |
|---|---|---|---|
| 1,153,836 | 9/1915 | Webb | 52/407 X |
| 1,997,605 | 4/1935 | Strom et al. | 52/407 X |
| 2,370,052 | 2/1945 | Lindelow | 52/361 |
| 2,910,150 | 10/1959 | Roseman | 52/407 X |
| 2,959,897 | 11/1960 | Baker | 52/410 X |
| 3,031,044 | 4/1962 | Stitt et al. | 52/410 X |
| 3,394,514 | 7/1968 | Lindner | 52/336 X |
| 3,394,524 | 7/1968 | Howarth | 52/712 X |
| 3,608,263 | 9/1971 | Gartner | 52/712 X |
| 3,812,636 | 5/1974 | Albrecht et al. | 52/336 X |

*Primary Examiner*—Price C. Faw, Jr.
*Assistant Examiner*—Robert C. Farber
*Attorney, Agent, or Firm*—Schmidt, Johnson, Hovey & Williams

[57] ABSTRACT

An easily installable, elongated insulation supporting strap for supporting insulation batts or the like between roof purlins is provided which includes respective male and female connection ends allowing aligned, end-to-end interlocking of a plurality of straps in order to support insulation between respective adjacent purlins and present an aesthetically pleasing roof construction. The straps are also configured for engagement with and support by the purlins, and can be appropriately modified to mate with standard types of metal purlins. In preferred forms the batts are supported in spaced relationship to the roof for creating an insulative dead air space therebetween, and separate roof-engaging insulation can be employed to provide further thermal insulation for the roof.

8 Claims, 4 Drawing Figures

INSULATION SUPPORTING STRAP

This invention relates to a strap especially designed for supporting batts or the like of insulation between roof purlins or joists to present an insulated, aesthetically pleasing roof construction. More particularly, it is concerned with a strap adapted for use with metal purlins and includes respective male and female connection ends allowing interlocking of a plurality of straps in end-to-end relationship, and in engagement with the respective purlins.

In recent years there has been a tremendous increase in the construction and use of prefabricated metal buildings. These have the advantages of drastically lowered construction costs and good flexiblity of design. However, one potential drawback with all metal buildings stems from the poor insulating qualities of metal. As can be appreciated, an uninsulated metal building exhibits very poor thermal qualities and can be prohibitively expensive to heat and cool. This problem, coupled with recent energy shortages and the concomitant price increases for fuel, has resulted in a situation where effective thermal insulation of metal buildings has become a matter of concern.

The obvious answer to the insulation problem involves use of insulative batts much like those found in conventional buildings. However, a problem has arisen in this regard because of the difficulty of supporting such batts adjacent the roof of a metal building. That is, such buildings are generally not provided with attics as in the case of houses, and it is therefore necessary to place the insulation batts in close proximity to the roof itself. In this connection, it has been suggested to place the batts between metal purlins normally attached to the underside of such building roofs, but this presents further problems. Specifically, in order to be economically feasible the support structure used in conjunction with the insulative batts must be relatively inexpensive and easy to install. Furthermore, the resultant overall assembly should also present a relatively pleasing appearance.

It is therefore the most important object of the present invention to provide an insulation supporting strap especially adapted for use in engaging and supporting insulation located between spaced, adjacent purlins or joists secured to the underside of a roof, in order to allow quick and easy installation of the insulation without detracting from the appearance of the building roof.

As a corollary to the foregoing, another object of the invention is to provide an insulation supporting strap including an elongated web section of length to substantially span adjacent purlins and including male and female connection ends configured to complementally interlock in order to permit aligned, end-to-end interconnection of a plurality of straps across a series of laterally spaced purlins; in particularly preferred forms, the strap is especially configured to engage with a projecting flange provided with the purlins so that spaced support points are provided for the interconnected straps along the length thereof.

Another object of the invention is to provide a unitary metallic insulation supporting strap having a female connection portion designed to complementally receive the male end of an adjacent strap and configured to fit between an insulation batt and an adjacent flange of a purlin for compressing the female connection portion; this serves to lock the male portion of the other straps in place so that the insulation, purlin flanges and straps cooperate to present a sturdy and effective insulation system for a building roof.

Figure 2:
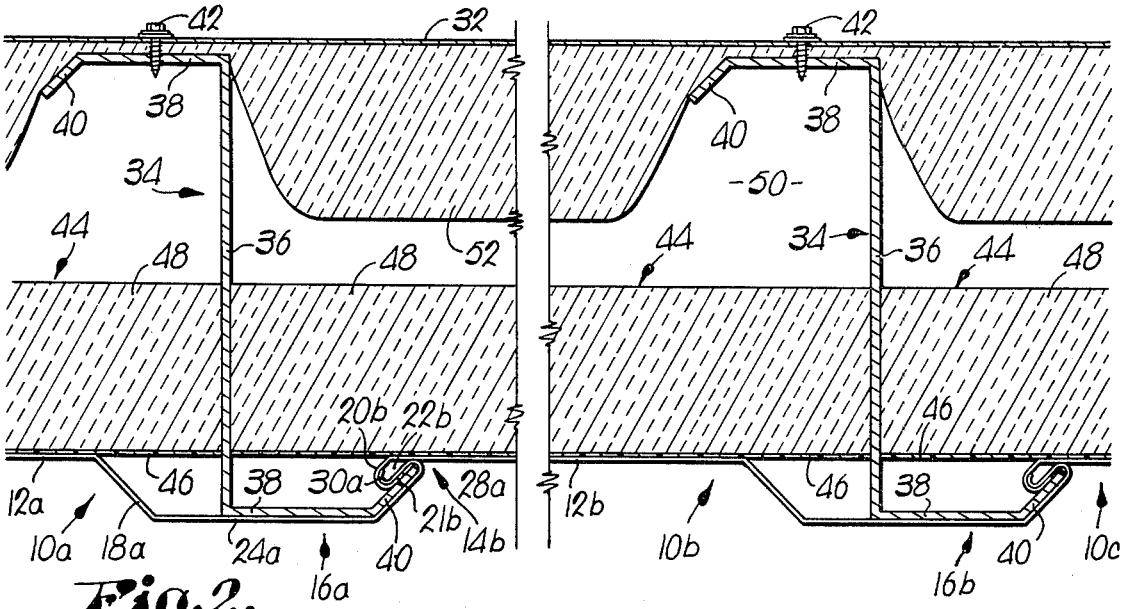
FIG. 2 is a fragmentary vertical sectional view of a double-insulated metal roof having a series of laterally spaced, flanged purlins connected thereto and with a series of end-to-end interconnected supporting straps engaging the spaced purlins and supportively engaging respective insulation batts.
Figure 3:
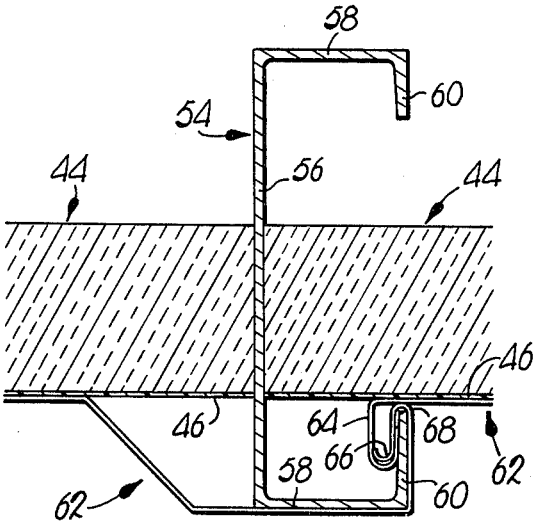
Figure 4:
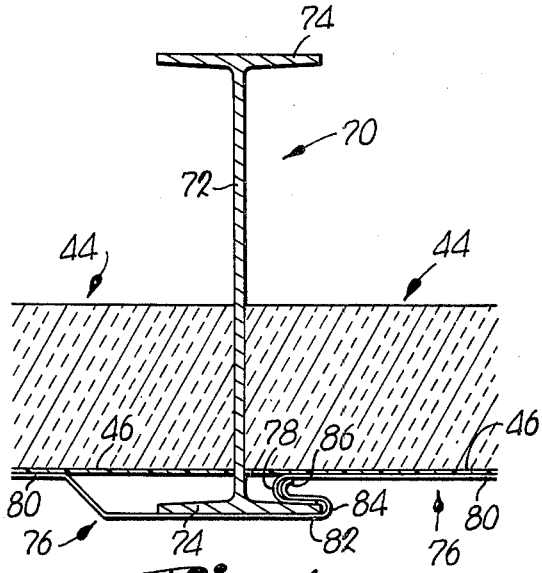

FIG. 3 is a fragmentary sectional view similar to that of FIG. 2 but illustrating another type of conventional metal purlin and the appropriately modified supporting straps used in conjunction therewith; and FIG. 4 is a fragmentary vertical sectional view similar to that of FIG. 2 and illustrating an I-beam type of metal purlin and the appropriately configured insulation supporting straps used in conjunction therewith.

Figure 1:
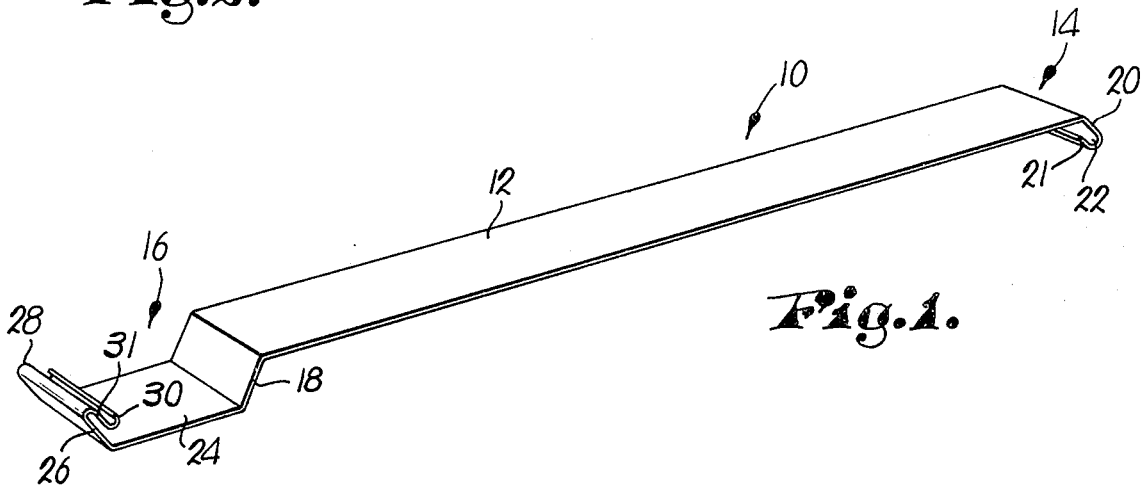
FIG. 1 is a perspective view of an insulation supporting strap in accordance with the invention.

An insulation supporting strap 10 in accordance with the invention is illustrated in perspective in FIG. 1. Strap 10 is of unitary, metallic construction and includes an elongated central web section 12 of length to substantially span the distance between adjacent purlins in a conventional roof construction, and is adapted to supportively engage an insulation batt or the like therebetween. Respective male and female end sections 14 and 16 are also provided, with the latter including an offset section 18.

In more detail, end section 14 includes a female portion 20 in the form of an obliquely depending, upwardly opening, generally U-shaped section terminating in a lowermost leg 21 and which presents a recess 22. On the other hand, end section 16 includes offset 18, a generally planar, purlin-engaging mid-section 24, and an obliquely upwardly extending male portion 26. The latter includes a generally U-shaped, downwardly opening bight section 28 and an upturned insertion section 30 extending from the uppermost leg 31 of bight section 28.

Referring now to FIG. 2, the use of a plurality of straps 10 in supporting a series of side-by-side insulation batts located between spaced metallic purlins is illustrated. In this instance a metallic roof 32 is provided which includes a plurality of elongated, laterally spaced purlins 34 of conventional construction. Each purlin 34 includes a planar main body portion 36 which extends downwardly from roof 32, along with respective, oppositely extending flanges 38 at the opposed ends of main body 36. As illustrated, each flange 38 includes a segment 40 which is oblique relative to the main body 36, with the segments 40 on the lower flanges 38 extending generally upwardly toward roof 32. Finally, it will be seen that appropriate connection screws 42 are employed for securing the respective purlins to roof 32.

A plurality of side-by-side, essentially conventional insulation batts 44 are respectively located between each adjacent pair of purlins 34. Each batt 44 includes a foil type vapor barrier 46 along with the usual insulative fill 48 thereabove. As seen in FIG. 2, the batts are preferably of a width to butt against the corresponding purlins 34, in order to create the most effective thermal insulation barrier for the overall roof construction.

Three longitudinally aligned, interlocked insulation supporting straps **10*a*, 10*b* and 10*c* are depicted in FIG. 2. Referring specifically to central strap 10*b*, it will be seen that the lowermost leg 21*b* thereof is in engagement with the upper surface of the adjacent oblique flange segment 40, while web section 12***b* is in supportive engagement with the overlying batt 44. The effect of this is to compress the defining legs of U-shaped female portion 20*b* together, which is important for reasons which will be made clear.

Interlocking of the straps 10*a* and 10*b* is achieved by insertion of section 30*a* into the recess 22*b* presented by portion 20*b*. In this regard, it will be seen that section 24*a* of male end section 16*a* is in engagement with the underside of lower flange 38, with the bight section 28*a* extending upwardly and complementally fitting over the uppermost terminal edge of flange segment 40. In this fashion section 30*a* can be inserted and locked within recess 22*b*, and the compression of portion 20*b* increases the locking effect. The interconnection of straps 10*b* and 10*c* is identical with that described above in connection with straps 10*a* and 10*b* and need not be repeated. However, it will be readily appreciated that essentially any number of straps in accordance with the invention can be interconnected simply by placing the straps in aligned, end-to-end relationship and snap-fitting the individual male ends 16 into the proximal female ends 22 of adjacent straps 10. This simultaneously has the effect of securing the interconnected straps to the respective purlins, since the male ends 16 each include a bight section 28 which complementally fits over and engages the respective upturned flange segments of the purlins. Moreover, in normal installations spaced sets of interconnected straps are employed along the length of the purlins so that the insulation batts are adequately supported. For example, separate sets can be provided at 3 foot intervals along the purlins to give the necessary support.

It is also important to note that the preferred overall roof construction hereof provides a dead air space 50 between the batts 44 and roof 32. This space is of course important in maintaining the effective thermal insulation barrier for the roof. In particularly preferred forms, separate insulation 52 can be provided which directly engages the underside of roof 32 and is held in place by the upper flanges of the spaced purlins. This construction gives separate insulation barriers which are spaced by dead air, in order to give the most advantageous thermal insulation properties to the roof construction. In addition, means can be provided for insulating the bottom flanges of the purlins 34 by making use of the laterally extending vapor barrier tabs (not shown) provided with the batts 44. This may involve placement of elongated insulation strips over the bottom flanges 38 of the purlins 34 between separate sets of interconnected straps 10, with the vapor barrier tabs being used to secure the insulation strips in place.

FIG. 3 illustrates another type of purlin 54 which is generally C-shaped in cross section and includes an elongated, depending generally planar main body 56 and respective upper and lower flanges 58 each having a terminal segment 60 which is parallel to body 56. In this case the supporting straps are appropriately modified for accommodating the flange construction of the C-shaped purlins 54, so as to achieve the result described in connection with FIG. 2. In particular, the interconnected straps 62 in this case include a generally downwardly extending, U-shaped female portion 64 which engages the lowermost segment 60 and receives the insertion segment 66 of the adjacent, oppositely extending strap. As before, the male end portions of the straps include an intermediate bight section 68 which fits over the uppermost edge of an adjacent segment 60 in order to provide spaced support points for the interconnected straps 62. In all other respects the straps 62 are identical with the straps 10.

Finally, a steel joist or purlin 70 is depicted in FIG. 4 which includes a downwardly extending main body 72 and respective, generally perpendicularly oriented flanges 74. Again, the straps 76 provided for use with this type of joist are appropriately configured for interlocking and support thereof. In detail, the female portions 78 of the straps are generally U-shaped and coplanar with the central web sections 80 thereof; and the lowermost legs of the section 78 engage the upper surface of a proximal flange 74. In addition, the male portions 82 include generally U-shaped intermediate bights 84 which fit over and engage the flanges 74 and include insertion segments 86 which fit within the adjacent, compressed U-shaped female portions 78.

It will thus be appreciated that an effective, easily installable insulation supporting strap is provided by the present invention which can be installed with a minimum of effort to give an aesthetically pleasing, thermally insulated roof construction. Although the present invention is particularly directed for use with metal roofs, it will be appreciated that other types of roof units can also benefit therefrom.

Having thus described the invention, what is claimed as new and desired to be secured by Letters Patent is:

1. An insulation supporting strap for supporting insulation located between spaced, adjacent purlins secured to the underside of a roof, said purlins having a projecting flange adjacent the end thereof remote from said roof, said strap comprising:

an elongated web section of length to substantially span the distance between first and second adjacent purlins and configured for supportively engaging said insulation located therebetween;

a first end section secured to the end of said web section proximal to said first purlin and including a female portion engageable with the flange of the first purlin and presenting a recess; and a second end section secured to the remaining end of said web section proximal to said second purlin and including a male portion configured to fit and be secured within the female portion of another of said straps in engagement with said second purlin and extending in a direction away from said strap and second purlin, said purlin flanges including segments which are oblique relative to the main body of the purlins depending from said roof and extending toward the latter, said female portion being complementally oblique and in depending relationship from said web section, said male portion including a generally U-shaped segment configured to fit over the uppermost edge of the oblique flange segment of the second purlin, and a segment extending from the uppermost leg of said U-shaped segment and complementally fitting within the obliquely oriented female portion of the other of said straps.

2. An insulation supporting strap for supporting insulation located between spaced, adjacent purlins secured to the underside of a roof, said purlins having a projecting flange adjacent the end thereof remote from said roof, said strap comprising:

an elongated web section of length to substantially span the distance between first and second adjacent purlins and configured for supportively engaging said insulation located therebetween;

a first end section secured to the end of said web section proximal to said first purlin and including a female portion engageable with the flange of the first purlin and presenting a recess; and a second end section secured to the remaining end of said web section proximal to said second purlin and including a male portion configured to fit and be secured within the female portion of another of said straps in engagement with said second purlin and extending in a direction away from said strap and second purlin, said purlin flanges including segments which are generally parallel to the main body of the purlins depending from said roof, and extend toward the latter, said female portion being generally vertical and depending relative to said web section, said male portion including a U-shaped segment configured to fit over the uppermost edge of the flange segment of said second purlin, and a segment depending from the uppermost leg of the U-shaped segment and complementally fitting within the vertically oriented female portion of the other of said straps.

3. An insulation supporting strap for supporting insulation located between spaced, adjacent purlins secured to the underside of a roof, said purlins having a projecting flange adjacent the end thereof remote from said roof, said strap comprising:

an elongated web section of length to substantially span the distance between first and second adjacent purlins and configured for supportively engaging said insulation located therebetween;

a first end section secured to the end of said web section proximal to said first purlin and including a female portion engageable with the flange of the first purlin and presenting a recess; and a second end section secured to the remaining end of said web section proximal to said second purlin and including a male portion configured to fit and be secured within the female portion of another of said straps in engagement with said second purlin and extending in a direction away from said strap and second purlin, said purlin flanges including segments which are generally perpendicular to the main body of the purlins depending from said roof and are generally parallel to the latter, said female portion being generally coplanar relative to said web section, said male portion including a generally U-shaped segment configured to fit over the outermost edge of the flange segment of the second purlin, and a segment extending inwardly from the uppermost leg of said U-shaped segment and complementally fitting within the female portion of the other of said straps.

4. In combination:

a plurality of elongated, laterally spaced purlins adapted for connection to the underside of a roof, each of said purlins including a main body extending downwardly from said roof;

elongated batts of insulation located between adjacent pairs of said purlins; and means for supporting said insulation batts in said location including a plurality of spaced straps respectively extending tranversely between adjacent purlins and in supportive engagement with corresponding insulation batts therebetween, said straps including structure adjacent the opposed ends thereof for interconnection of said plurality of straps in generally aligned, end-to-end relationship.

5. The combination as set forth in claim 4 wherein each of said purlins include a flange portion adjacent the end thereof remote from said roof, each of said straps including means adjacent at least one of the ends thereof for engaging said flange portions for supporting said interconnected straps.

6. The combination as set forth in claim 5 wherein said connection structure includes a female end section and a complemental male end section at the opposed ends of each of said straps, said male sections being configured for complemental interfitting within the female portions of adjacent straps.

7. The combination as set forth in claim 4 wherein said purlins and insulation batts are cooperatively configured and arranged for supporting the latter in spaced relationship to said roof.

8. The combination as set forth in claim 5 including insulative material separate from said batts in engagement with said roof and interposed between the latter and said purlins.

* * * * *